US008827557B2

(12) United States Patent
Wallander

(10) Patent No.: US 8,827,557 B2
(45) Date of Patent: Sep. 9, 2014

(54) GUSSETED BAG WITH EASY-OPEN LAP SEAL

(75) Inventor: Aaron J. Wallander, Neenah, WI (US)

(73) Assignee: Curwood, Inc., Oshkosh, WI (US)

( * ) Notice: Subject to any disclaimer, the term of this patent is extended or adjusted under 35 U.S.C. 154(b) by 0 days.

(21) Appl. No.: 13/978,176

(22) PCT Filed: Mar. 9, 2011

(86) PCT No.: PCT/US2011/027659

§ 371 (c)(1),
(2), (4) Date: Jul. 3, 2013

(87) PCT Pub. No.: WO2012/121716

PCT Pub. Date: Sep. 13, 2012

(65) Prior Publication Data

US 2013/0279833 A1 Oct. 24, 2013

(51) Int. Cl.

| | |
|---|---|
| ***B65D 33/16*** | (2006.01) |
| ***B65D 30/08*** | (2006.01) |
| ***B65D 30/20*** | (2006.01) |
| ***B65D 65/40*** | (2006.01) |

(52) U.S. Cl.

CPC ..... *B65D 65/40* (2013.01); *B65D 31/02* (2013.01); *B65D 31/10* (2013.01)

USPC ..... 383/120; 383/121; 383/210; 428/35.2; 428/35.9

(58) Field of Classification Search

CPC ..... B65D 31/02; B65D 65/40; B65D 31/10

USPC ..... 428/35.7, 36, 91, 35.2, 35.9; 383/210, 383/120, 121

See application file for complete search history.

(56) References Cited

U.S. PATENT DOCUMENTS

| | | | | |
|---|---|---|---|---|
| 3,381,886 | A * | 5/1968 | Goglio | 383/121 |
| 4,783,178 | A * | 11/1988 | Herder | 383/120 |
| 4,913,561 | A * | 4/1990 | Beer | 383/94 |
| 6,534,137 | B1 * | 3/2003 | Vadhar | 428/34.9 |
| 6,630,237 | B2 | 10/2003 | Rivett et al. | |

(Continued)

FOREIGN PATENT DOCUMENTS

| | | | |
|---|---|---|---|
| EP | 1749655 | A1 | 2/2007 |
| WO | 02068196 | A1 | 9/2002 |

OTHER PUBLICATIONS

Written Opinion for PCT/US2011/027659 Mar. 5, 2011.*

Amcor Flexibles Technical Data Sheet, "Amcor FlexCan", 2010.

(Continued)

*Primary Examiner* — N. Edwards

(74) *Attorney, Agent, or Firm* — Tom J. Hall

(57) ABSTRACT

An end-sealed packaging bag comprising a multilayer non-heat shrinkable film and an easy open lap seal is provided. The film comprises at least four layers, including an inner heat sealing layer, a contaminated layer, a barrier layer, and an outer heat sealing layer. The film, when formed into a bag, is defined by a front panel, and opposing back panel connected to one another by a pair of side gusset panels. The bag further comprises a peelable lap seal connecting the inner heat sealing layer to the outer heat sealing layer of the film. The bag further comprises a first end seal connecting the inner heat sealing layer on the front panel with the inner heat sealing layer on the back panel between the side gusset panels and proximate to the first end of the bag.

22 Claims, 3 Drawing Sheets

(56) References Cited

U.S. PATENT DOCUMENTS

| | | | | |
|---|---|---|---|---|
| 7,276,267 | B2 * | 10/2007 | Schauz | 427/554 |
| 7,527,839 | B2 * | 5/2009 | Busche et al. | 428/34.9 |
| 7,951,461 | B2 * | 5/2011 | ReFraschini et al. | 428/500 |
| 2004/0146226 | A1 * | 7/2004 | Wolak et al. | 383/210 |
| 2004/0166262 | A1 | 8/2004 | Busche et al. | |
| 2004/0170851 | A1 | 9/2004 | Lischefski | |
| 2005/0129811 | A1 | 6/2005 | Kraimer et al. | |
| 2007/0202337 | A1 | 8/2007 | Lischefski et al. | |
| 2007/0212550 | A1 * | 9/2007 | ReFraschini et al. | 428/411.1 |
| 2008/0292821 | A1 * | 11/2008 | Dayrit et al. | 428/34.9 |
| 2009/0068486 | A1 * | 3/2009 | Blackwell et al. | 428/516 |
| 2010/0183830 | A1 | 7/2010 | Berbert | |
| 2013/0279833 | A1 * | 10/2013 | Wallander | 383/210 |

OTHER PUBLICATIONS

Rovema Technical Data Sheet "FlexCan", 2005.

* cited by examiner

FIG. 1
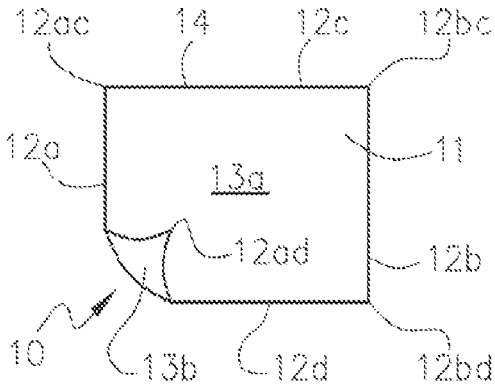
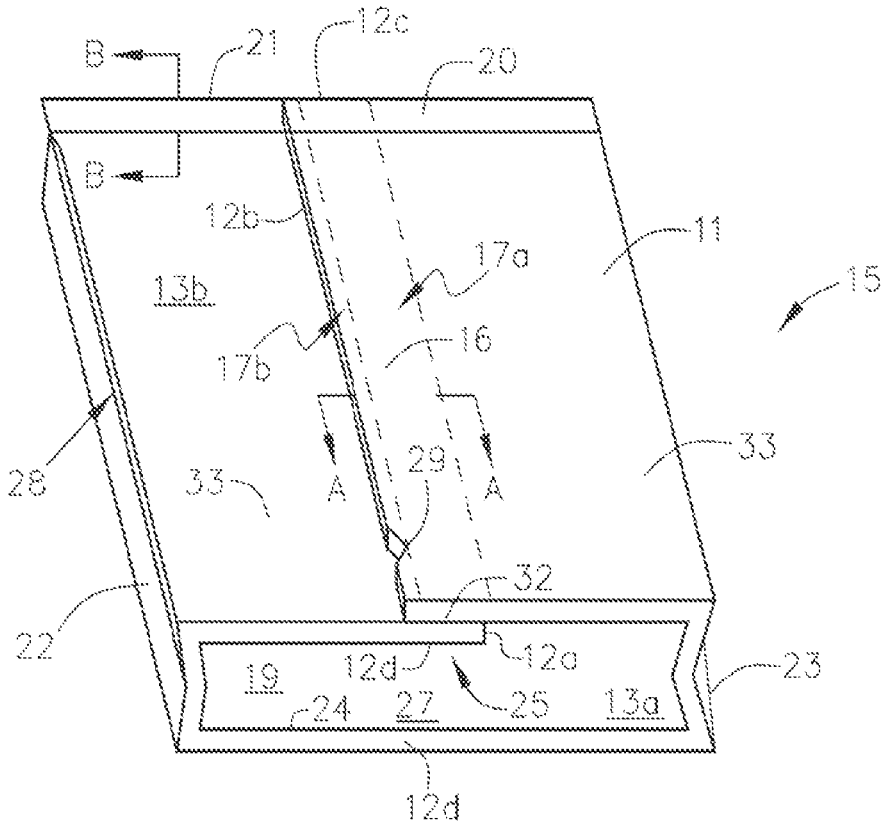
FIG. 2

GUSSETED BAG WITH EASY-OPEN LAP SEAL

BACKGROUND

Flexible multilayer thermoforming films are used to package such food item packages, thereby protecting these articles against external contamination and abuse, and therein providing an attractive package for the article for its eventual sale. In certain instances, it is desirable to hermetically seal food item packages, such as blocks of natural cheese to preserve the food item.

A typical packaging bag has three sides heat-sealed by the bag manufacturer leaving one open side to allow product insertion. After a product is inserted, the bag is typically evacuated and the bag mouth sealed to enclose the product. At one time, the standard method for sealing was to fasten a clip around the mouth of the bag. However, heat sealing techniques are now also commonly employed to produce the final closure of the bag. For example, a bag mouth may be either hot bar sealed or impulse sealed. An impulse seal is made by application of heat and pressure using opposing bars similar to the hot bar seal except that at least one of these bars has a covered wire or ribbon through which electric current is passed for a very brief time period (hence the name "impulse") to cause the adjacent film layers to fusion bond. Following the impulse of heat the bars are typically cooled (e.g., by circulating coolant) while continuing to hold the bag inner surfaces together to achieve adequate sealing strength.

There is great commercial interest in the packaging industry for a film structure, which provides superior properties such as mechanical strength, optical and gas barrier properties, and thermoformability, for example, while having an easy open peelable seal. However, disadvantages remain with existing technology. One particular problem during heat sealing the film is that of excessively high tear propagation strengths. Although strong heat seals provide protection against unwanted seal failure, such seals also make it difficult for the end user to open the package. Accordingly, there is a need for an improved non-heat shrinkable film for a packaging bag that includes a lap seal readily openable by the end user without the use of a knife or cutting implement, and without uncontrolled or random tearing or rupturing of the packaging materials.

BRIEF SUMMARY

In one embodiment, the packaging bag comprises a multilayer non-heat shrinkable film. The film comprises an outer heat sealing layer, an inner heat sealing layer, an oxygen barrier layer positioned between the inner heat sealing layer and outer sealing layer, and a contaminated layer positioned between the outer heat sealing layer and the oxygen barrier layer. The film is formed into a bag defined by a front panel and an opposing back panel connected to one another by a pair of side gusset panels, wherein either the front or back panel comprises a lap seal connecting the inner heat sealing layer to the outer heat sealing layer of the film, and wherein the lap seal extends between a first end and opposing second end of the bag. The film is further defined by a first end seal connecting the inner heat sealing layer on the front panel with the inner heat sealing layer on the back panel between the side gusset panels and proximate to the first end of the bag. In this embodiment, the lap seal is peelable along a lap seal interface located between the outer heat sealing layer and the contaminated layer, where the lap seal has a lap seal peel strength between 250 grams per inch and 3000 grams per inch.

In another embodiment, the packaging bag comprises a multilayer non-heat shrinkable film. The film comprises at least seven layers arranged in sequence and in contact with one another. The first layer of the film is an outer heat sealing layer comprising at least 50 wt % of at least one material selected from the group consisting of: linear low density polyethylene, low density polyethylene, high density polyethylene, and mixtures thereof. The second layer of the film is a contaminated layer comprising polybutene and at least one other constituent selected from the group consisting of: ultra-low density polyethylene, anhydride-modified linear low density polyethylene, and cyclic olefin copolymer, and mixtures thereof. The third layer of the film is an inner layer comprising at least one material selected from the group consisting of: nylon-6, nylon-6/6,6, and mixtures thereof. The fourth layer of the film is a barrier layer comprising between 90-100 wt % of an ethylene vinyl alcohol copolymer having an ethylene content between 38-44 mol %. The fifth layer of the film is an inner layer comprising at least one material selected from the group consisting of: nylon-6, nylon-6/6,6, and mixtures thereof. The sixth layer of the film is an inner layer comprising at least one material selected from the group consisting of: ultra low density polyethylene, modified-linear low density polyethylene, cyclic olefin copolymers, and mixtures thereof. The seventh layer of the film is an inner heat sealing layer comprising at least 50 wt % of at least one material selected from the group consisting of: linear low density polyethylene, low density polyethylene, high density polyethylene, and mixtures thereof. In this embodiment, the film is formed into a bag defined by a front panel and an opposing back panel connected to one another by a pair of side gusset panels, wherein either the front or back panel comprises a lap seal connecting the inner heat sealing layer to the outer heat sealing layer of the film, and wherein the lap seal extends between a first end and opposing second end of the bag. The film is further defined by a first end seal connecting the inner heat sealing layer on the front panel with the inner heat sealing layer on the back panel between the side gusset panels and proximate to the first end of the bag. In this embodiment, the lap seal is peelable along a lap seal interface located between the outer heat sealing layer and the contaminated layer, where the lap seal has a lap seal peel strength between 250 grams per inch and 3000 grams per inch.

BRIEF DESCRIPTION OF THE DRAWINGS

The following detailed description of specific embodiments can be best understood when read in conjunction with the following drawings, where like structure is indicated with like reference numerals.

FIG. 1 illustrates a schematic view of a film suitable for making a peelable, sealed gusseted bag.

FIG. 2 illustrates a schematic view of a non-heat shrinkable, gusseted bag in a substantially lay-flat position.

DETAILED DESCRIPTION

Figure 3:
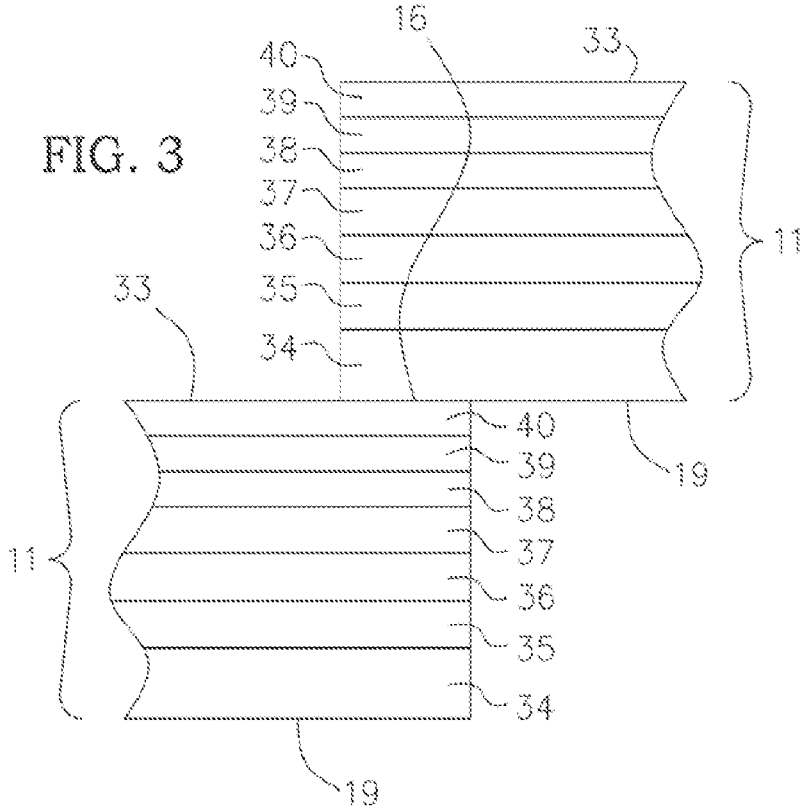
FIG. 3 illustrates a fragmentary cross-sectional view taken along lines A-A of FIG. 2 depicting an enlarged, not to scale, lap seal area of a film for use in fabricating the bag.

For the purposes of promoting an understanding of the principles of the invention, reference will now be made to the embodiments illustrated in the drawings, and specific language will be used to describe the same.

As used herein, terms such as "preferably" and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

As used herein, the term "multilayer" refers to a plurality of layers in a single film structure, generally in the form of a sheet or web which can be made from a polymeric material or a non-polymeric material bonded together by any conventional means known in the art, e.g., coextrusion, extrusion coating, lamination, vacuum vapor deposition coating, solvent coating, emulsion coating, suspension coating, or a combination of one or more thereof.

As used herein, the term "polymer" refers to the product of a polymerization reaction, and is inclusive of homopolymers, copolymers, terpolymers, etc. In certain embodiments, the layers of a film can consist essentially of a single polymer, or can have still additional polymers blended therewith.

As used herein, the term "copolymer" refers to polymers formed by the polymerization of reaction of at least two different monomers. In certain embodiments, the term "copolymer" includes the co-polymerization reaction product of ethylene and an α-olefin, such as 1-hexene. The term copolymer is also inclusive of, for example, the co-polymerization of a mixture of ethylene, propylene, 1-propene, 1-butene, 1-hexene, and 1-octene. As used herein, a copolymer identified in terms of a plurality of monomers, e.g., "propylene/ethylene copolymer," refers to a copolymer in which either monomer may copolymerize in a higher weight or molar percent than the other monomer or monomers. However, the first listed monomer preferably polymerizes in a higher weight percent than the second listed monomer.

As used herein, terminology employing a "/" with respect to the chemical identity of a copolymer (e.g., polyvinylidene chloride/methyl acrylate copolymer), identifies the co-monomers which are copolymerized to produce the copolymer.

As used herein, the term "ethylene/vinyl alcohol copolymer" or EVOH, refers to hydrolyzed copolymers of ethylene and vinyl acetate monomers. Ethylene/vinyl alcohol copolymers can be represented by the general formula: $[(CH_2—CH_2)_m—(CH_2—CH(OH))_n]$. In certain embodiments, ethylene/vinyl alcohol copolymers include saponified or hydrolyzed ethylene/vinyl acrylate copolymers, and refer to a vinyl alcohol copolymer having an ethylene co-monomer. In certain embodiments, EVOH is prepared by, for example, hydrolysis of vinyl acrylate copolymers or by chemical reactions with vinyl alcohol. The degree of hydrolysis is preferably at least 50%, and more preferably, at least 85%. In certain embodiments, ethylene/vinyl alcohol copolymers comprise 28-48 mol % ethylene, 32-44 mol % ethylene, or 38-44 mol % ethylene. Non-limiting examples of commercially available ethylene/vinyl alcohol copolymers include, but are not limited to, the SOARNOL® family of resins, e.g., SOARNOL® ET3803, supplied by Nippon Synthetic Chemical Industry Company, Ltd. (Nippon Gohsei), Osaka, Japan.

As used herein, the term "polyolefin" refers to homopolymers, copolymers, including, e.g., bipolymers, terpolymers, etc., having a methylene linkage between monomer units which may be formed by any method known to those skill in the art. In certain embodiments, suitable examples of polyolefins include polyethylene, low density polyethylene (LDPE), linear low density polyethylene (LLDPE), very low density polyethylene (VLDPE), ultra low density polyethylene (ULDPE), medium density polyethylene (MDPE), high density polyethylene (HDPE), polyethylenes comprising copolymers of ethylene with one or more alpha-olefins (α-olefins) such as butene-1, hexene-1, octene-1, or the like as a co-monomer. Additional non-limiting examples of polyolefins include cyclic olefin copolymers (COC), ethylene/propylene copolymers (PEP), polypropylene (PP), propylene/ethylene copolymer (PPE), polyisoprene, polybutylene (PB), polybutene-1, poly-3-methylbutene-1, poly-4-methylpentene-1, and propylene/α-olefins (P/AO) which are copolymers of propylene with one or more α-olefins (alpha-olefins) such as butene-1, hexene-1, octene-1, or the like as a comonomer. Non-limiting examples of commercially available polyethylenes include, but are not limited to, the linear low-density polyethylene family of resins supplied by ExxonMobil Chemical Company, Houston, Tex., USA. One particularly suitable grade includes, but is not limited to, ExxonMobil ESCORENE® LLDPE LL1001.32 having a melt index of 1.0 g/10 min., a density of 0.918 g/cm$^3$, and a melting point of 121° C. A non-limiting example of a commercially available polypropylene is sold under the trademark BP Amoco ACCLEAR® 6219 from Innovene, Chicago, Ill., USA. Non-limiting examples of commercially available cyclic olefin copolymers include, but are not limited to, the TOPAS® family of resins, e.g., TOPAS® 8007, supplied by Celanese-Ticona, Summit, N.J., USA.

As used herein, unless otherwise indicated, the term "polyethylene" includes polyethylene, low density polyethylene (LDPE), linear low density polyethylene (LLDPE), very low density polyethylene (VLDPE), ultra low density polyethylene (ULDPE), medium density polyethylene (MDPE), high density polyethylene (HDPE), ethylene/α-olefin copolymers, and combinations thereof.

As used herein, the phrase "ethylene/α-olefin" refers to a modified or unmodified copolymer produced by the co-polymerization of ethylene and any one or more α-olefin. In certain embodiments, the α-olefin invention may comprise between 3-20 pendant carbon atoms. The co-polymerization of ethylene and an α-olefin may be produced by heterogeneous catalysis and may be found in patents such as U.S. Pat. No. 4,302,565 to Goeke et al. and U.S. Pat. No. 4,302,566 to Karol et al. both of which are hereby incorporated, in their entireties, by reference thereto. In certain embodiments, heterogeneous catalyzed copolymers of ethylene and an α-olefin may include linear low density polyethylene, very low density polyethylene and ultra low density polyethylene. These copolymers of this type are available from, for example, Dow Chemical Company, Midland, Mich., USA and sold under the trademark DOWLEX® resins. Additionally, in certain embodiments, the co-polymerization of ethylene and a α-olefin may also be produced by homogeneous catalysis, for example, co-polymerization reactions with metallocene catalysis systems which include constrained geometry catalysts, i.e., monocyclopentadienyl transition-metal complexes taught in U.S. Pat. No. 5,026,798, to Canich, the teachings of which are incorporated herein by reference. Homogeneous catalyzed ethylene/α-olefin copolymers may include modified or unmodified ethylene/α-olefin copolymers having a long-chain branched (8-20 pendant carbons atoms) α-olefin co-monomer available from Dow Chemical Company, known as AFFINITY® and ATTANE® resins, TAFMER® linear copolymers obtainable from the Mitsui Petrochemical Corporation, Tokyo, Japan, and modified or unmodified ethylene/α-olefin copolymers having a short-chain branched (3-6 pendant carbons atoms) α-olefin comonomer known as EXACT® resins obtainable from ExxonMobil Chemical Company, Houston, Tex., USA.

In certain embodiments, homogeneous catalyzed ethylene/α-olefin copolymers may be characterized by one or more methods known to those of skill in the art, such as molecular weight distribution ($M_w/M_n$), composition distribution breadth index (CDBI), narrow melting point range, and single melt point behavior. The molecular weight distribution ($M_w/M_n$), also known as "polydispersity," can be determined by gel permeation chromatography (GPC) where $M_w$ is defined as the weight-average molecular weight and $M_n$ is defined as the number-average molecular weight. The molecular weight determination of polymers and copolymers can be measured as outlined in ASTM D-3593-80, which is incorporated herein in its entirety by reference. Ethylene/α-olefin copolymers of the present invention may be homogeneous catalyzed copolymers of ethylene and an α-olefin which may have a $M_w/M_w$ of less than 2.7. The composition distribution breadth index (CDBI) of the homogeneous catalyzed copolymers of ethylene and an α-olefin will generally be greater than about 70%. This is contrasted with heterogeneous catalyzed copolymers of ethylene and an α-olefin which may have a broad composition distribution index of generally less than 55%. The CDBI is defined as the weight percent of the copolymer molecules having a comonomer content within 50 percent (i.e., plus or minus 50%) of the median total molar comonomer content. The Composition Distribution Breadth Index (CDBI) may be determined via the technique of Temperature Rising Elution Fractionation (TREF) as described by Wild, et al., *Journal of Polymer Science, Poly. Phys. Ed.*, Vol. 20, p. 441 (1982) and U.S. Pat. No. 4,798,081, which are both incorporated herein, in their entireties, by reference.

In certain embodiments, homogeneous catalyzed ethylene/α-olefin copolymers may exhibit an essentially singular melting point characteristic, with a melting point ($T_m$), determined by Differential Scanning calorimetry (DSC). As used herein, "essentially singular melting point" means that at least about 80%, by weight, of the material corresponds to a single $T_m$ peak. DSC measurements may be made on a Perkin Elmer System 7 Thermal Analysis System according to ASTM D-3418, which is hereby incorporated, in its entirety, by reference thereto.

As used herein, the term "modified" refers to a chemical derivative, e.g., one having any form of anhydride functionality, such as anhydride of maleic acid, crotonic acid, citraconic acid, itaconic acid, fumaric acid, etc., whether grafted onto a polymer, copolymerized with a polymer, or blended with one or more polymers, and is also inclusive of derivatives of such functionalities, such as acids, esters, and metal salts derived therefrom. Non-limiting examples of commercially available anhydride-modified polyolefins include, but are not limited to, the BYNEL® family of resins, e.g., BYNEL® 41E687, supplied by du Pont de Nemours and Company, Wilmington, Del., USA.

As used herein, the term "ionomer" refers to an ionic copolymer formed from an olefin and an ethylenically unsaturated monocarboxylic acid having the carboxylic acid moieties partially neutralized by a metal ion. Suitable metal ions may include, but are not limited to, potassium, lithium, cesium, nickel, zinc and sodium. Suitable carboxylic acid co-monomers may include, but are not limited to, ethylene/methacrylic acid, methylene succinic acid, maleic anhydride, vinyl acetate/methacrylic acid, methyl/methacrylate/methacrylic acid, styrene/methacrylic acid and combinations thereof. In certain embodiments, useful ionomer resins may include an olefinic content of at least 50 mol % based upon the copolymer and a carboxylic acid content of between 5-25 mol % based upon the copolymer. In certain embodiments, useful ionomers are also described in U.S. Pat. No. 3,355,319 to Rees, which is incorporated herein by reference in its entirety. Non-limiting examples of commercially available ionomers include, but are not limited to, the SURLYN® family of resins, e.g., SURLYN® 1601, supplied by du Pont de Nemours and Company, Wilmington, Del., USA.

As used herein, the terms "polyamide" and "nylon" refer to homopolymers or copolymers having an amide linkage between monomer units which may be formed by any method known to those skilled in the art. The amide linkage can be represented by the general formula: $[R—C(O)N—R']_n$ where R and R'=the same or different alkyl group. In certain embodiments, useful polyamide homopolymers include nylon 6 (polycaprolactam), nylon 11 (polyundecanolactam), nylon 12 (polyauryllactam), and the like. In other embodiments, useful polyamide homopolymers include nylon 4,2 (polytetramethylene ethylenediamide), nylon 4,6 (polytetramethylene adipamide), nylon 6,6 (polyhexamethylene adipamide), nylon 6,9 (polyhexamethylene azelamide), nylon 6,10 (polyhexamethylene sebacamide), nylon 6,12 (polyhexamethylene dodecanediamide), nylon 7,7 (polyheptamethylene pimelamide), nylon 8,8 (polyoctamethylene suberamide), nylon 9,9 (polynonamethylene azelamide), nylon 10,9 (polydecamethylene azelamide), nylon 12,12 (polydodecamethylene dodecanediamide), and the like. In additional embodiments, useful polyamide copolymers include nylon 6,6/6 copolymer (polyhexamethylene adipamide/caprolactam copolymer), nylon 6,6/9 copolymer (polyhexamethylene adipamide/azelaiamide copolymer), nylon 6/6,6 copolymer (polycaprolactam/hexamethylene adipamide copolymer), nylon 6,2/6,2 copolymer (polyhexamethylene ethylenediamide/hexamethylene ethylenediamide copolymer), nylon 6,6/6,9/6 copolymer (polyhexamethylene adipamide/hexamethylene azelaiamide/caprolactam copolymer), as well as other nylons which are not particularly delineated here. In yet other embodiments, useful polyamides include nylon 4,I, nylon 6,I, nylon 6,6/6I copolymer, nylon 6,6/6T copolymer, MXD6 (poly-m-xylylene adipamide), nylon 6T/6I copolymer, nylon 6/MXDT/I copolymer, nylon MXDI, poly-p-xylylene adipamide, polyhexamethylene terephthalamide, polydodecamethylene terephthalamide and the like. Non-limiting examples of commercially available polyamides include, but are not limited to, the ULTRAMID® family of resins (e.g., ULTRAMID® B36 nylon 6) supplied by BASF, Mount Olive, N.J., USA and ZYTEL® family of resins provided by du Pont de Nemours and Company, Wilmington, Del., USA.

As used herein, the term "coextruded" refers to the process of extruding two or more materials through a single die with two or more orifices arranged so that the extrudates merge and weld together into a laminar structure before chilling and solidifying.

As used herein, the term "heat sealing" refers to sealing opposing portions of film (at the lap seal interface or at the end seal interface) with heat. In one embodiment, the heat sealing is conducted with a PW3124 Precision Heat Sealer with a RES-440 Heat Seal Controller by Packworld USA, Nazareth, Pa.

As used herein, the terms "heat seal layer" or "heat sealing layer" refer to a layer which is heat sealable to itself or another heat sealing layer, i.e., capable of fusion bonding by conventional indirect heating means which generate sufficient heat on at least one film contact surface for conduction to the contiguous film contact surface and formation of a bond interface therebetween without loss of the film integrity. In certain embodiments, the bond interface is sufficiently thermally stable to prevent gas or liquid leakage therethrough.

As used herein, the term "peelable seal" refers to a seal that is engineered to be readily peelable without uncontrolled or random tearing or rupturing of the packaging materials that may result in premature destruction of the package and/or inadvertent contamination or spillage of the contents of the package. In certain embodiments, a peelable seal is one that can be manually peeled apart to open the package at the seal without resort to a knife or other implement to tear or rupture the package. Many varieties of peelable seals are known in the art, such as those disclosed in U.S. Pat. No. 4,944,409 (Busche et al.); U.S. Pat. No. 4,875,587 (Lulham et al.); U.S. Pat. No. 3,655,503 (Stanley et al.); U.S. Pat. No. 4,058,632 (Evans et al.); U.S. Pat. No. 4,252,846 (Romesberg et al.); U.S. Pat. No. 4,615,926, (Hsu et al.) U.S. Pat. No. 4,666,778 (Hwo); U.S. Pat. No. 4,784,885 (Carespodi); U.S. Pat. No. 4,882,229 (Hwo); U.S. Pat. No. 6,476,137 (Longo); U.S. Pat. No. 5,997,968 (Dries, et al.); U.S. Pat. No. 4,189,519 (Ticknor); U.S. Pat. No. 5,547,752 (Yanidis); U.S. Pat. No. 5,128,414 (Hwo); U.S. Pat. No. 5,023,121 (Pockat, et al.); U.S. Pat. No. 4,937,139 (Genske, et al.); U.S. Pat. No. 4,916,190 (Hwo); and U.S. Pat. No. 4,550,141 (Hoh), the disclosures of which are incorporated herein in their entirety by reference.

As used herein, the term "permanent seal" refers to a seal that is not capable of being readily peelable without resort to a knife or other implement to tear or rupture the package.

As used herein, the term "peel strength" refers to the force required to separate at least a portion of the interface between two adjoining interior film layers when the film has been sealed to a second thermoplastic film. The peel strength may depend on the chemical similarity or dissimilarity of the two film layers and their individual thickness. Peel strength may also be affected by the composition and thickness of adjacent film layers that are ruptured during the separation of the interface. Peel strength may still further be affected by environmental conditions during film fabrication, the packaging process and whether there has been an initial separation of the interface and the number of times the interface has been separated and resealed. One method for determining bond strength is ASTM F-904 test method entitled, "Standard Test Method for Comparison of Bond Strength or Ply Adhesion of Similar Laminates Made from Flexible Materials" and published by ASTM International, West Conshohocken, Pa., USA, which is herein incorporated by reference in its entirety. In certain embodiments, peel strengths may be determined in accordance with ASTM F-904 test method, including a modification to the test procedure. The modification entails preparing test specimens by heat-sealing the surface of the subject film along its entire length to a second thermoplastic film with an end-portion of the subject film unsealed to the second film. With the test specimens prepared in this manner, the unsealed end-portion of the subject film is then peeled from the second film at an angle of at 180° relative to the second film.

As used herein, the terms "core," "barrier," or "barrier layer" refer to a layer of the multilayer film that acts as a physical barrier to moisture or oxygen molecules, or controls the oxygen permeability of the film.

As used herein, the term "contaminant" refers to a material within a film layer that is capable of weakening the film layer, making it easier to peel open the bag along the lap seal interface, for example, allowing easy access to the product.

As used herein, the term "contaminated layer" refers to a film layer comprising a contaminant. In certain embodiments, the contaminated layer is designed to tear within each layer or at each layer's interface with its adjacent layer, making the bag easier to open along the lap seal interface, for instance. In certain embodiments, peeling within these layers or at their interfaces will occur with a relatively small amount of force in comparison to the force typically required to peel apart two sections of similar film layers that have been heat sealed together.

As used herein, the term "non-heat shrinkable film" refers to a film capable of having an unrestrained linear thermal shrinkage of less than 10% in at least one and preferably both the machine and transverse directions when immersed in water at 90° C. for five seconds, as measured in accordance with ASTM D-2732 test method. In certain embodiments, the film has an unrestrained linear thermal shrinkage of less than 5% in at least one and preferably both the machine and transverse directions at 90° C. In yet other embodiments, the film has an unrestrained linear thermal shrinkage of less than 2% in at least one and preferably both the machine and transverse directions at 90° C.

Gusseted Bag

FIG. 1 depicts an embodiment of a film that is capable of forming a non-heat shrinkable, easy open bag. A sheet 10 of non-heat shrinkable film 11 having a first side edge 12*a* and opposing, second side edge 12*b* connected by a third side edge 12*c* and a fourth side edge 12*d*. First side edges 12*a* and second 12*b* are preferably parallel to each other when film 11 is in a long flat planar state. Third side edge 12*c* and fourth side 12*d* are preferably parallel to each other when film 11 is in a lay flat planar state. First and second side edges 12*a*, 12*b* are also preferably perpendicular to third and fourth side edges 12*c*, 12*d* when film 11 is in a lay flat planar state. Film 11 has four corners at the intersections of the four sides with first corner 12*ac* defined by the junction of first side edge 12*a* with third side edge 12*c*; second corner 12*b* defined by the junction of first side edge 12*a* with third side edge 12*c*; second corner 12*bc* defined by the junction of second side edge 12*b* with third side edge 12*c*; third corner 12*ad* defined by the junction of first side edge 12*a* with fourth side edge 12*d*; and fourth corner 12*bd* defined by the junction of second side edge 12*b* with fourth side edge 12*d*. Film 11 has a top surface 13*a* circumscribed by a perimeter 14 formed by sides 12*a*, 12*c*, 12*b* and 12*d* with an opposing bottom surface 13*b* also circumscribed by said perimeter 14. FIG. 1 depicts corner 12*ad* of film 11 turned upward to reveal said bottom surface 13*b*.

In certain embodiments, the multilayer film 11 is a non-oriented multilayer film.

Referring now to FIG. 2, a bag 15 is made from the film 11 of FIG. 1. In certain embodiments, the bag 15 is formed by overlapping the first side edge 12*a* with the second side edge 12*b* and sealing, preferably by heat, to produce a lap seal 16 defined by parallel spaced apart dotted lines 17*a* and 17*b*, and the third side edge 12*c* and the fourth side edge 12*d*. In certain embodiments, the lap seal 16 is preferably a heat seal forming a fusion bond between the top surface 13*a* and the bottom surface 13*b* of the film 11.

It should be noted that while the lap seal 16 is depicted as a continuous elongated rectangle extending from side 12*c* to side 12*d*, in certain embodiments, the seal shape may vary and could, for example, form a wavy line or zigzag shape or other shapes as desired. Also, in certain embodiments, the width of the seal may be varied to be thicker or thinner as desired. Also, in some embodiments, the seal may be made by alternatives or additional means, including, e.g., by applications of suitable flue or adhesive material known in the art for sealing together films. In certain embodiments, the strength of the lap seal may be varied by selection of aforesaid parameters such as seal shape, thickness, continuous or intermittent nature, material selection type of and known parameter for varying the strength of different types of seals. For example, in some embodiments, the lap seal strength may be adjusted by adjusting the dwell time or the temperature for producing heat seals. Such variations and adjustments may be made by those skilled in the art without undue experimentation.

Referring again to FIG. 2, in certain embodiments, the overlapped, sealed film 11 comprises a first side gusset 22 and a second side gusset 23 formed between a front panel 26 and an opposite back panel 27 of the film 11. The side gusset formations allow the film to expand and contract between a substantially open, rectangular position and a substantially closed, flat position, wherein the film 11 folds along a crease 28 in each gusset.

It is noted that the lap seal 16 does not need to be centered between the side gussets 22 and 23, but preferably is positioned anywhere therebetween on either the front panel 26 or opposite back panel 27 of the bag 15.

In certain embodiments, a first end seal 20 extends laterally across the overlapped, sealed film 11 proximal to the third side edge 12*c* of the film 11, thereby forming a closed bag end 21. A variety of seals may be used. In one embodiment, the first end seal 20 will be a heat seal that bonds the bag film inner surface 19 to itself. In certain embodiments, the first end seal 20 bonds the inner surface of the front panel 26 to the inner surface of the back panel 27. This inner surface to inner surface seal in FIG. 2 defines an embodiment of a "fin seal." In certain embodiments, the first end seal 20 extends between the first side gusset 22 and the second side gusset 23. The first end seal 20 may also employ a variety of shapes, thicknesses, structures, etc. (such as a "fin seal" as depicted in FIG. 2).

Opposite the closed bag end 21 is a bag mouth formed by lap sealed film under fourth side edge 12*d* through which a product may be placed into a product receiving chamber 25 defined by the overlapped, sealed film 11, closed bag end 21 and bag mouth 24. After insertion of the product, the bag is sealed with a second end seal, extending laterally the overlapped, sealed film 11 proximal to the fourth side edge 12*d* of the film, thereby forming a sealed bag with inserted product. In certain embodiments, like the first end seal 20, the second end seal extends between the first side gusset 22 and second side gusset 23. In one embodiment, the second end seal is a heat seal that bonds the bag film inner surface 19 to itself. In certain embodiments, the second end seal bonds the inner surface of the front panel 26 to the inner surface of the back panel 27.

In certain embodiments, both the first and second end seals are provided in a manner such that the lap seal 16 is positioned within either the front panel 26 or the back panel 27. This provides one seamless panel and two side gussets that may include printed images applied to the film before forming the bag, or after the bag is formed.

Additionally, the first and second end seals may take any shape, whether straight or curved, so long as the first end seal 20 operates to close the end 21 and the second end seal operates to close the bag mouth 24.

Figure 5:
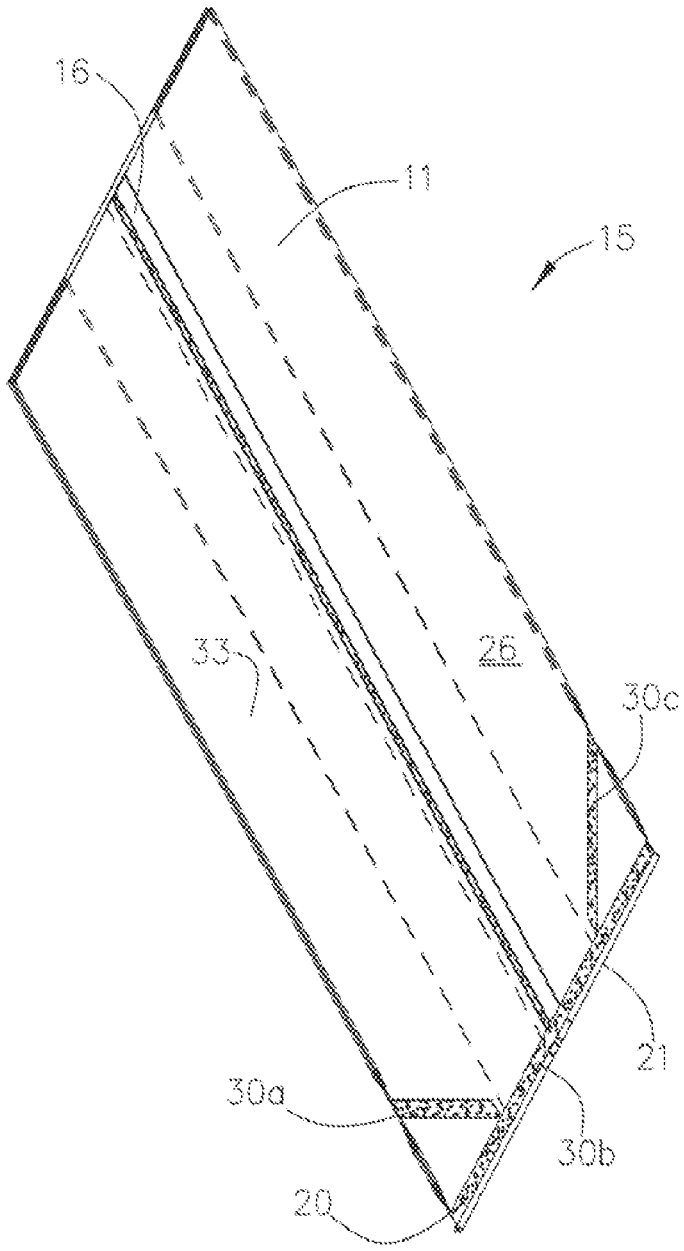
FIG. 5 illustrates a schematic view of a non-heat shrinkable, gusseted bag in a substantially lay-flat position.

In certain embodiments, as shown in FIG. 5, the closed bag end 21 may be sealed in the form of a "K-seal" having at least three heat seals 30*a*, 30*b*, and 30*c* proximal to the closed bag end 21 that provide a squared end configuration, allowing the bag 15 to stand upright before it is filed. In other embodiments, the closed bag end 21 may be sealed in the form of a single transverse seal. In certain embodiments, like the closed bag end 21, the opposite bag end may be sealed in the form of a single transverse seal.

Referring back to FIG. 2, in certain embodiments, a notch 29 may be positioned on the lap seal 16, allowing the gusseted bag 15 to be torn open in the transverse direction, perpendicular to the lap seal 16. In certain embodiments, because the bag 15 is made from a non-oriented film 11, the bag 15 may be opened at the notch 29 with relative ease and in approximately a straight line along a transverse direction. In some embodiments, the notch 29 is positioned proximal to the first end seal 20. In other embodiments, the notch 29 is positioned proximal to the second end seal.

In certain embodiments, the lap seal 16 is a peelable seal, while the first and second end seals are permanent seals wherein the end seals have sufficient strength to remain sealed and prevent failure of the seals during the non-heat shrinking process, as well as further normal handling and transportation of the packaged article. In addition, in certain embodiments, the permanent end seals are not capable of being readily peelable without resort to a knife or other implement to tear or rupture the package.

In certain embodiments, the lap seal 16 has a lap seal peel strength of about 250 grams per inch of material to about 3000 grams per inch. In some embodiments, the lap seal peel strength is between about 500 and 3000 grams per inch. In other embodiments, the lap seal peel strength is between about 1000 and 3000 grams per inch.

Non-Heat Shrinkable Film Material

Films for use in fabricating the gusseted bags may be selected from multilayer, non-heat shrinkable films capable of forming a peelable lap seal interface. In certain embodiments, the multilayered film is non-oriented. In certain embodiments, the films may provide a beneficial combination of one or more or all of the below noted properties including: relatively low permeability to oxygen and water vapor; resistance to degradation by food acids, salts and fat; high shrinkage values at ambient temperature conditions; residual shrink force which forms and maintains a compact product; good to excellent heat sealability especially over a broad voltage range on commercial sealers; low levels of extractables with compliance with governmental regulations for food contact; low haze; high gloss; does not impart off tastes or odors to packaged food; good tensile strength; a surface which is printable; high puncture resistance (e.g., as measured by the ram and/or hot water puncture tests); and good machinability.

In certain embodiments, the multilayered films may be made by any suitable and known film-making process, e.g., cast or blown through either an annular or flat die, and is preferably fully coextruded. In certain embodiments, the multilayer film may be generally prepared from dry resins which are melted in an extruder and passed through a die to form the primary film material, most commonly in a tube form. In some embodiments, the well-known single bubble blown film process may be used to prepare the multilayer film.

In certain embodiments, the thermoplastic resins utilized in the multilayer film are generally commercially available in pellet form and, as generally recognized in the art, may be melt blended or mechanically mixed by well-known methods using commercially available equipment including tumblers, mixers or blenders. Also, in some embodiments, well known additives such as processing aids, slip agents, anti-blocking agents and pigments, and mixtures thereof may be incorporated into the film layers, by blending prior to extrusion. In certain embodiments, the resins and any additives are introduced to an extruder where the resins are melt plastified by heating and then transferred to an extrusion (or coextrusion) die for formation into a tube. Extruder and die temperatures will generally depend upon the particular resin or resin containing mixtures being processed and suitable temperature ranges for commercially available resins are generally known in the art, or are provided in technical bulletins made available by resin manufacturers. Processing temperatures may vary depending upon other processing parameters chosen.

Since the gusseted bags may advantageously be used to hold oxygen or moisture sensitive articles such as food products after evacuation and sealing, it is preferred to use a thermoplastic film that includes an oxygen and/or moisture barrier layer. In certain embodiments, the barrier layer material in conjunction with the other film layers will provide an oxygen gas transmission rate ("$O_2$GTR") of less than 70 $cm^3/m^2$, less than 45 $cm^3/m^2$, or less than 15 $cm^3/m^2$ in 24 hours at one atmosphere at a temperature of 23° C. and 0% relative humidity (as measured in accordance with ASTM D-3985-81 test method). In another embodiment, the gas permeability is controlled to allow the escape of $CO_2$, e.g., for packaging respiring foods such as cheese as described in U.S. Pat. No. 6,511,688, incorporated herein by reference.

In certain embodiments, the film has an unrestrained linear thermal shrinkage of less than 10% in at least one and preferably both the machine and transverse directions, when immersed in water at 90° C. for five seconds, as measured in accordance with ASTM D-2732 test method. In other embodiments, the film has an unrestrained linear thermal shrinkage of less than 5% in at least one and preferably both the machine and transverse directions at 90° C. In yet other embodiments, the film has an unrestrained linear thermal shrinkage of less than 2% in at least one and preferably both the machine and transverse directions at 90° C.

In certain embodiments, the multilayer film has a film thickness of about 16 mils (406.4 microns) or less. In other embodiments, the multilayer film has a film thickness of 10 mils (254 microns) or less. In yet other embodiments, the film thickness is between about 1 and 4 mils (25.4-101.6 microns) or between about 2 and 3 mils (50.8-76.2 microns). Such films have good abuse resistance and machinability. Films thinner than 2 mils may be less abuse resistant and more difficult to handle in packaging processes.

In certain embodiments, the multilayer film has a gloss value greater than about 65 Hunter Units (HU) as measured in accordance with ASTM D-2244-85 test method.

In certain embodiments, the multilayer film comprises at least four layers. In one embodiment, the at least four layers include an outer heat sealing layer, a contaminant layer, oxygen barrier layer, and an inner heat sealing layer. The inner and outer heat sealing layers are disposed on opposing sides of the oxygen barrier layer. In certain embodiments, the oxygen barrier layer and outer heat sealing layer are disposed on opposing sides of the contaminant layer. In other embodiments, additional "inner layers" may be included in the multilayer film, and positioned between the inner and outer heat sealing layers. When the film is bag form, these layers comprise the walls of the bag.

It is contemplated that films having more than four layers may also be constructed and that such additional layers may be disposed as additional inner layers lying between the core or barrier layer and either or both of the inner sealing layer and outer sealing layer. In certain embodiments, the multilayer film comprises seven layers connected to each other in the following order: (1) an outer heat sealing layer, (2) a contaminated layer, (3) an inner layer, (4) an oxygen barrier layer, (5) an inner layer, (6) an inner layer, and (7) an inner heat sealing layer.

One embodiment of a multilayer film structure for use in fabricating a gusseted bag with a peelable lap seal is illustrated in FIG. 3, which depicts an enlarged, end view of the peelable lap seal 16 in FIG. 2 made from the sheet of non-heat shrinkable film 11. Layer thicknesses in FIG. 3 and other figures presented herein are not to scale, but are dimensioned for ease of illustration. One embodiment of the easy to peel lap seal for a non-heat shrinkable film 11 is a seven layer film, from the inner surface 19 of the tube member 19 (see FIG. 2) to an opposing outer surface 33. The layers comprise:

(a) an outer heat sealing layer 40,
(b) a contaminated layer 39,
(c) an inner layer 38,
(d) an oxygen barrier layer 37,
(e) an inner layer 36,
(f) an inner layer 35, and
(g) an inner heat sealing layer 34.

In certain embodiments, the film layer thicknesses for a four to seven layer non-heat shrinkable film may be about 1-30% of the overall film for the first (outer heat sealing) layer, 5-50% for a second (contaminated) layer, 0-30% third (inner) layer, 3-13% fourth (barrier) layer, 0-30% fifth (inner) layer, 0-50% sixth (inner) layer, and 1-30% seventh (inner heat sealing) layer, although films with differing layer ratio thicknesses are possible. In other embodiments, more film layers may be present, potentially altering the typical layer thicknesses.

As depicted in FIG. 3, in certain embodiments, the lap seal 16 is made by longitudinally heat sealing the inner film surface 19 of film 11 to the outer film surface 33 along their respective lengths, such that inner film surface 19 and outer film surface 33 overlap. In this manner, a fusion bond is made between the inner heat sealing layer 34 and the outer heat sealing layer 40. The peelable bond for the lap seal 16 is provided by the contaminated layer 39 and peeling at the interface with the outer heat sealing layer 40 and/or at the interface with inner layer 38 and/or between outer heat sealing layer 40 and inner layer 38.

Figure 4:
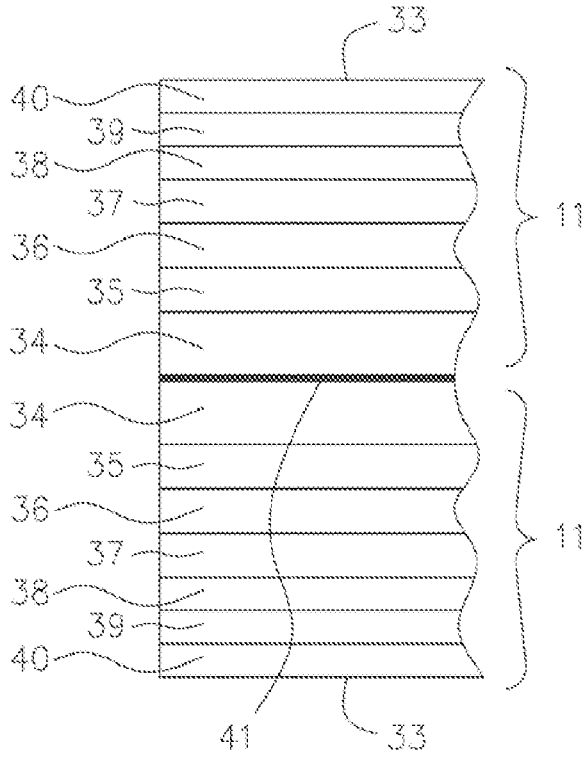
FIG. 4 illustrates a fragmentary cross-sectional view taken along lines B-B of FIG. 2 depicting an enlarged, not to scale, end seal area.

Referring to FIG. 4, a fragmentary sectional view taken along lines B-B of FIG. 2 illustrates how an embodiment works to create a permanent end seal. In FIG. 4, film 11 has an outer surface 33 with consecutive layers therefrom of outer heat sealing layer 40, contaminated layer 39, inner layer 38, barrier layer 37, inner layer 36, and inner layer 35, and inner sealing layer 34. Referring to FIG. 2, the second seal 20 is provided between the front panel 26 and back panel 27 of the film 11 to collapse the film's surface 19 upon itself. Referring again to FIG. 4, this seal bonds the inner surface heat sealing layer 34 to itself, creating the end seal interface 41.

As mentioned, the inner layer 34 typically comprises the interior surface layer of the tube where in use it will contact a foodstuff encased by the tube. Preferably, the inner layer is a heat sealing layer which allows the film to be formed into bags. A heat sealing layer is capable of fusion bonding by conventional indirect heating means which generate sufficient heat on at least one film contact surface for conduction to the contiguous film contact surface and formation of a bond interface therebetween without loss of the film integrity. Advantageously, the bond interface must be sufficiently thermally stable to prevent gas or liquid leakage therethrough when exposed to above or below ambient temperatures during processing of food within the tube when sealed at both ends, i.e., in a sealed bag form. Finally, the bond interface between contiguous inner layers must have sufficient physical strength to withstand the tension resulting from stretching or shrinking due to the presence of a food body sealed within the film.

In certain embodiments, the inner layer 34 as the interior surface layer will, when used to package foodstuffs, be suitable for contact with foodstuffs containing protein, water and fat without evolving or imparting harmful materials, off tastes or odors to the foodstuff.

In certain embodiments, the inner heat sealing layer 34 may comprise at least 50 wt %, 60 wt %, 70 wt %, 80 wt %, or 90 wt %, of one of the following materials: polyethylenes, propylene/ethylene copolymers, ethylene/vinyl acetate copolymers, and ionomers. In certain embodiments, the inner heat sealing layer comprises a material selected from the following group consisting of: linear low density polyethylene (LLDPE), low density polyethylene (LDPE), high density polyethylene (HDPE), and combinations thereof. In one embodiment, the inner heat sealing layer comprises LLDPE and LDPE. In another embodiment, the inner heat sealing layer comprises LDPE and HDPE. In yet another embodiment, the inner heat sealing layer comprises HDPE. One example of a suitable HDPE resin is Equistar M6020, available from LyondellBasell Industries, Houston, Tex., USA, and having a density of 0.960 g/cc, a melt index of 2.00 g/10 min (ASTM D1238), and a melting temperature between 199-210° C.

Also, it is preferred that the multilayer film's outer heat sealing layer 40 will comprise the exterior surface of the tube or bag. As the exterior surface layer of the tube or bag, the outer layer should be resistant to abrasions, abuse, and stresses caused by handling and it should further be easy to machine (i.e. be easy to feed through and be manipulated by machines e.g. for conveying, packaging, printing or as part of the film or bag manufacturing process). It should also facilitate stretch orientation where a high shrinkage film is desired.

In certain embodiments, the outer heat sealing layer 40 is comprised of similar materials present in the inner heat sealing layer, which assists in creating a strong seal along the lap seal interface between the inner and outer film layers. Therefore, the outer heat sealing layer 40 may also comprise at least 50 wt %, 60 wt %, 70 wt %, 80 wt %, or 90 wt %, of one of the following materials: polyethylenes, propylene/ethylene copolymers, ethylene/vinyl acetate copolymers, and ionomers. In certain embodiments, the outer heat sealing layer comprises a material selected from the following group consisting of: LLDPE, LDPE, HDPE, and combinations thereof. In one embodiment, the outer heat sealing layer comprises LLDPE and LDPE. In another embodiment, the outer heat sealing layer comprises LDPE and HDPE. In yet another embodiment, the outer heat sealing layer comprises HDPE.

A barrier or core layer 37 is present between the inner and outer heat sealing layers that comprises at least one material independently selected from group consisting of: ethylene vinyl alcohol copolymers (EVOH), polyacrylonitriles, polyamides, vinylidene chloride copolymers (PVDC), polyglycolide copolymers, and mixtures thereof. The barrier layer functions as a controlled gas barrier, and provides the necessary oxygen barrier for preservation of the article to be packaged. In certain embodiments, the barrier layer 37 also provides good optical properties when stretch oriented, including low haze and a stretching behavior compatible with the layers around it. In some embodiments, the barrier layer has a thickness greater than about 0.05 mil (1.27 microns) and less than about 0.45 mil (10.16 microns) to provide the desired combination of the performance properties sought, e.g., with respect to oxygen permeability, shrinkage values, ease of orientation, delamination resistance, and optical properties. In certain embodiments, the suitable thickness of the barrier layer is less than about 15%, typically about 3-13% of the total film thickness. In certain embodiments, the barrier layer comprises: at least about 90 wt %, preferably about 100 wt %, of an ethylene vinyl alcohol (EVOH) copolymer resin having an ethylene content of about 38-44 mol %.

In certain embodiments, a contaminated layer 36 is positioned between the barrier layer 37 and the outer heat sealing layer 40. In certain embodiments, the contaminated layer 39 is selected to have relatively low peel strength when peelably bonded to the outer heat sealing layer 40, or additional intermediate layer between the outer heat sealing layer 40 and contaminated layer 39.

In certain embodiments, the contaminated layer 39 is designed to tear within each layer or at each layer's interface with its adjacent layer, making the lap seal 16 easier to open. The contaminated film layer 39 is selected such that peeling occurs by breaking apart the contaminated layer 39 and/or a bond between the contaminated layer 39 and the outer heat sealing layer 40. Peeling within this layer or at the layer interface will occur with a relatively small amount of force in comparison to the force typically required to peel apart two sections of similar film layers that have been heat sealed together. In other words, certain "contaminant" materials within the contaminated layer will weaken the film layer, making it easier to peel open the bag along the lap seal interface, allowing easy access to the product.

Selection of the various materials determines the nature of the bond, i.e., whether it is permanent, peelable, fracturable, or combinations thereof. The contaminated layer materials typically depend on the polymer resin used to make up the contaminated layer 39. In certain embodiments, the contaminated layer comprises polybutene and at least one polyethylene compound. In certain embodiments, the contaminated layer contains polybutene and at least one other constituent selected from the group consisting of: ultra-low density polyethylene (ULDPE), anhydride-modified linear low density polyethylene (mod-LLDPE), and cyclic olefin copolymer (COC). In some embodiments, the amount of polybutene in the contaminated layer is between 0.1 and 30 wt %. The term "polybutene" as used herein includes having polymeric units derived from butene-1 as the major (75% polymeric units) components and preferably at least 80% of its polymeric units will be derived from butene-1. One possible polybutene is a random copolymer of butene-1 with ethylene having a reported density of 0.908 g/cm$^3$ and a melt index of 1.0 g/10 min. and a melting point of 243° F. (117° C.), which is commercially available from LyondellBasell Industries, Houston, Tex., USA under the trade name PB 8640.

In certain embodiments, an additional inner layer 38 may be present between the contaminant layer 39 and the barrier layer 37 to provide assistance in tying the adjoining layers together. Additionally, additional inner layers 36 and/or 35 may be located between the barrier layer 37 and the inner heat sealing layer 34 to serve similar functions. These inner layers may individually comprise at least one of the following materials: polyamides or nylons, polyethylenes, propylene/ethylene copolymers, ethylene/vinyl acetate copolymers, and ionomers. In certain embodiments, inner layers 35 and 38 may individually comprise a nylon selected from the group consisting of nylon-6, nylon-6/6,6, and mixtures thereof. In other embodiments, inner layer 39 may comprise a combination of ULDPE, mod-LLDPE, and/or COC.

EXAMPLES

Experimental results and reported properties of the following examples are based on the following test methods or substantially similar methods, unless otherwise noted:

Tear Resistance: ASTM #1922-94A
Tensile Yield: ASTM # D-882
Tensile Elongation: ASTM # D-882
Tensile Peak Stress: ASTM # D-882
Tensile Peak Load: ASTM # D-882
Tensile Modulus: ASTM # D-882

Following are examples given to illustrate embodiments of the invention.

Example 1

In this example, a non-heat shrinkable multilayer film comprising seven layers is produced. The first, outer heat seal layer consists of 65.2 wt % linear low density polyethylene (LLDPE), 26 wt % low density polyethylene (LDPE), 6 wt % polyethylene antiblock additives, 2.5 wt % slip additives, and 0.3 wt % LLDPE processing aids. One example of a suitable LLDPE resin is Exxon 1001.32 from ExxonMobil Chemical, Houston, Tex., USA. One example of a suitable LDPE resin is Dow 608A from Dow Chemical, Midland, Mich., USA. One example of a suitable polyethylene antiblock additive is Ampacet 10853 from Ampacet Corporation, Tarrytown, N.Y., USA: One example of a suitable slip additive is Ampacet 100041. Finally, one example of a suitable LLDPE processing aid is Ampacet 102113.

The second, contaminant layer consists of 60 wt % ultra low density polyethylene (ULDPE), 24 wt % polybutene-1 (PB), and 16 wt % anhydride-modified LLDPE (mod-LLDPE). One example of a suitable ULDPE resin is Dow ATTANE® NG 4701G from Dow Chemical, Midland, Mich., USA. One example of a suitable polybutene resin is PB 8640M from LyondellBasell Industries, Houston, Tex., USA. One example of a suitable LLDPE tie layer resin is Equistar PLEXAR 3308, also available from LyondellBasell Industries.

The third, inner layer consists of 80 wt % nylon PA-6 resin and 20 wt % nylon PA-6/6,6 resin. One example of a suitable PA-6 resin is Ultramid B36 from BASF, Ludwigshafen, Germany. One example of a suitable PA-6/6,6 resin is C40-I-01 from BASF as well.

The fourth, oxygen barrier layer consists of 100 wt % EVOH resin comprising 38 wt % ethylene. One example of a suitable EVOH resin is SOARNOL® ET 3803 RB from Nippon Gohsei, Osaka, Japan.

The fifth, inner layer consists of 80 wt % nylon PA-6 resin and 20 wt % nylon PA-6/6,6 resin, similar to the third layer.

The sixth, inner layer consists of 73 wt % ULDPE, 16 wt % mod-LLDPE, and 11 wt % polyethylene concentrates. Examples of ULDPE and mod-LLDPE are discussed above for the second layer. One example of a polyethylene concentrate is Ampacet 160668 from Ampacet Corporation, Tarrytown, N.Y., USA.

The seventh, inner heat sealing layer consists of 80.7 wt % LLDPE, 10 wt % LDPE, 6 wt % polyethylene antiblock additives, 3 wt % slip additives, and 0.3 wt % LLDPE processing aids. Examples of suitable materials are discussed above for the first, inner heat sealing layer.

The resins for each film layer were coextruded at a first, second, third, fourth, fifth, sixth, and seventh layer outlet thickness ratio of about 22.3:16.9:9.2:9.4:9.2:16.9:16.2. For each layer, the resin or resin mixture is fed from a hopper into an attached single screw extruder where the resin and/or resin mixture is heat plastified and extruded through a spiral plate die into a primary tube. The extruded multilayer primary tube is cooled with cold tap water or cold air, and flattened with a pair of nip rollers.

Example 2

In this example, a non-heat shrinkable multilayer film comprising seven layers is produced. The first, outer heat sealing layer consists of 60.7 wt % LDPE, 30 wt % high density polyethylene (HDPE), 6 wt % polyethylene antiblock additives, 3 wt % slip additives, and 0.3 wt % LLDPE processing aids. One example of a suitable LDPE resin is Dow 608A from Dow Chemical, Midland, Mich., USA. One example of a suitable HDPE resin is Equistar M6020 from Lyondell-Basell Industries, Houston, Tex., USA. One example of a suitable polyethylene antiblock additive is Ampacet 10853 from Ampacet Corporation, Tarrytown, N.Y., USA. One example of a suitable slip additive is Ampacet 100041. Finally, one example of a suitable LLDPE processing aid is Ampacet 102113.

The second, contaminant layer consists of 49 wt % ULDPE, 30 wt % polybutene, 16 wt % mod-LLDPE, and 5 wt % cyclic olefin copolymer (COC). One example of a suitable ULDPE resin is Dow ATTANE® NG 4701G from Dow Chemical, Midland, Mich., USA. One example of a suitable polybutene resin is PB 8640M from LyondellBasell Industries, Houston, Tex., USA. One example of a suitable LLDPE tie layer resin is Equistar PLEXAR 3308, also available from LyondellBasell Industries. Finally, one example of a suitable COC is TOPAS 5013X14 from Topas Advanced Polymers, Florence, Ky., USA.

The third, inner layer consists of 80 wt % nylon PA-6 resin and 20 wt % nylon PA-6/6,6 resin. One example of a suitable PA-6 resin is Ultramid B36 from BASF, Ludwigshafen, Germany. One example of a suitable PA-6/6,6 resin is C40-I-01 from BASF as well.

The fourth, oxygen barrier layer consists of 100 wt % EVOH resin comprising 38 wt % ethylene. One example of a suitable EVOH resin is SOARNOL® ET 3803 RB from Nippon Gohsei, Osaka, Japan.

The fifth, inner layer consists of 80 wt % nylon PA-6 resin and 20 wt % nylon PA-6/6,6 resin, similar to the third layer.

The sixth, inner layer consists of 68 wt % ULDPE, 16 wt % mod-LLDPE, 11 wt % polyethylene concentrates, and 5 wt % cyclic olefin copolymer (COC). Examples of ULDPE, mod-LLDPE, and COC are discussed above for the second layer. One example of a polyethylene concentrate is Ampacet 160668 from Ampacet Corporation, Tarrytown, N.Y., USA.

The seventh, inner heat sealing layer consists of 60.7 wt % LDPE, 30 wt % high density polyethylene (HDPE), 6 wt % polyethylene antiblock additives, 3 wt % slip additives, and 0.3 wt % LLDPE processing aids, similar to the first, inner heat sealing layer.

The resins for each film layer were coextruded at a first, second, third, fourth, fifth, sixth, and seventh layer outlet thickness ratio of about 22.3:16.9:9.2:9.4:9.2:16.9:16.2. For each layer, the resin or resin mixture is fed from a hopper into an attached single screw extruder where the resin and/or resin mixture is heat plastified and extruded through a spiral plate die into a primary tube. The extruded multilayer primary tube is cooled with cold tap water or cold air, and flattened with a pair of nip rollers.

Examples 1 and 2 were tested tear resistance, tensile yield, tensile elongation, tensile peak stress, tensile peak load, and tensile modulus. The results are shown below in Table 1.

TABLE 1

| Film Property | Ex. 1 | Ex. 2 |
|---|---|---|
| Tear Resistance Machine Direction (gram-force) | 119 | 102 |
| Tear Resistance Transverse Direction (gram-force) | 240 | 315 |
| Tensile Yield Machine Direction (psi) | 2494 | 2795 |
| Tensile Yield Transverse Direction (psi) | 2472 | 2748 |

TABLE 1-continued

| Film Property | Ex. 1 | Ex. 2 |
|---|---|---|
| Tensile Elongation Machine Direction (%) | 587 | 574 |
| Tensile Elongation Transverse Direction (%) | 662 | 629 |
| Tensile Peak Stress Machine Direction (psi) | 5490 | 5743 |
| Tensile Peak Stress Transverse Direction (psi) | 5162 | 4960 |
| Tensile Peak Load Machine Direction (pound-force) | 16.1 | 16.9 |
| Tensile Peak Load Transverse Direction (pound-force) | 14.4 | 14.9 |
| Tensile Modulus Machine Direction (psi) | 64407 | 75702 |
| Tensile Modulus Transverse direction (psi) | 67193 | 77270 |

What is claimed is:

1. An individual, end-sealed packaging bag comprising:

a multilayer non-heat shrinkable film comprising:

(a) an inner heat sealing layer, (b) an outer heat sealing layer, (c) an oxygen barrier layer positioned between the inner heat sealing layer and outer sealing layer, (d) a contaminated layer positioned between the outer heat sealing layer and the oxygen barrier layer;

the film being formed into a bag defined by:

a front panel and an opposing back panel connected to one another by a pair of side gusset panels, wherein either the front or back panel comprises a lap seal connecting the inner heat sealing layer to the outer heat sealing layer of the film, and wherein the lap seal extends between a first end and opposing second end of the bag:

a first end seal connecting the inner heat sealing layer on the front panel with the inner heat sealing layer on the back panel between the side gusset panels and proximate to the first end of the bag;

wherein the lap seal is peelable along a lap seal interface located between the outer heat sealing layer and the contaminated layer, where the lap seal has a lap seal peel strength between 250 grams per inch and 3000 grams per inch; and wherein the first end seal comprises a K-seal formation having at least three discreet heat seals proximal to the closed bag end which provides a squared end configuration to the bag and allows the bag to stand upright before it is filled.

2. The bag, as defined in claim 1, further comprising a second end seal connecting the inner heat sealing layer on the front panel with the inner heat sealing layer on the back panel between the side gusset panels and proximate to the second end of the bag.

3. The bag, as defined in claim 1, further comprising a notch on the lap seal for opening the bag in a transverse direction, perpendicular to the lap seal.

4. The bag, as defined in claim 1, wherein the film has an oxygen gas transmission rate of less than 70 $cm^3/m^2$ for a 24 hour period at 1 atmosphere, 0% relative humidity, and 23° C.

5. The bag, as defined in claim 1, wherein the film has an unrestrained linear thermal shrinkage value of less than 10% in both machine and transverse directions when submerged in water at 90° C. for 5 seconds.

6. The bag, as defined in claim 1, wherein the inner and outer heat sealing layers of the film independently comprise at least 50 wt % of at least one material selected from the group consisting of: polyethylenes, propylene/ethylene copolymers, ethylene/vinyl acetate copolymers, ionomers, and mixtures thereof.

7. The bag, as defined in claim 1, wherein the inner and outer heat sealing layers of the film independently comprise at least 50 wt % of at least one material selected from the group consisting of: linear low density polyethylene, low density polyethylene, high density polyethylene, and mixtures thereof.

8. The bag, as defined in claim 1, wherein the inner and outer heat sealing layers of the film independently comprise linear low density polyethylene and low density polyethylene.

9. The bag, as defined in claim 1, wherein the inner and outer heat sealing layers of the film independently comprise low density polyethylene and high density polyethylene.

10. The bag, as defined in claim 1, wherein the inner and outer heat sealing layers of the film independently comprise linear low density polyethylene and high density polyethylene.

11. The bag, as defined in claim 1, wherein the barrier layer of the film comprises 90-100 wt % of an ethylene vinyl alcohol copolymer having an ethylene content between 38-44 mol %.

12. The bag, as defined in claim 1, wherein the contaminated layer comprises 0.1-30 wt % polybutene.

13. The bag, as defined in claim 1, wherein the contaminated layer comprises 0.1-30 wt % polybutene and at least one other constituent selected from the group consisting of: ultra-low density polyethylene, anhydride-modified linear low density polyethylene, cyclic olefin copolymer, and mixtures thereof.

14. The bag, as defined in claim 1, wherein the lap seal peel strength is about 500 to about 3000 grams per inch.

15. The bag, as defined in claim 1, wherein the lap seal peel strength is about 1000 to about 3000 grams per inch.

16. The bag, as defined in claim 1, wherein the film further comprises an inner layer positioned between the inner heat sealing layer and the oxygen barrier layer, wherein the inner layer comprises at least one material selected from the group consisting of: nylons, polyethylenes, polypropylenes, propylene/ethylene copolymers, ethylene/vinyl acetate copolymers, polyesters, polyvinyl chlorides, ionomers, and mixtures thereof.

17. The bag, as defined in claim 16, wherein the inner layer comprises nylon-6 and nylon-6/6,6.

18. The bag, as defined in claim 1, wherein the film further comprises at least one inner layer positioned between the outer heat sealing layer and the barrier layer, wherein the at least one inner layer comprises at least one material selected from the group consisting of: nylons, polyethylenes, polypropylenes, propylene/ethylene copolymers, ethylene/vinyl acetate copolymers, polyesters, polyvinyl chlorides, ionomers, and mixtures thereof.

19. The bag, as defined in claim 18, wherein the at least one inner layer comprises nylon-6 and nylon-6/6,6.

20. An individual, end-sealed packaging bag comprising:

a multilayer non-heat shrinkable film comprising at least seven layers arranged in sequence and in contact with one another comprising:

(a) a first, outer heat sealing layer comprising at least 50 wt % of at least one material selected from the group consisting of linear low density polyethylene, low density polyethylene, high density polyethylene, and mixtures thereof, (b) a second, contaminated layer comprising polybutene and at least one other constituent selected from the group consisting of ultra-low density polyethylene, anhydride-modified linear low density polyethylene, and cyclic olefin copolymer, and mixtures thereof, (c) a third, inner layer comprising at least one material selected from the group consisting of: nylon-6, nylon-6/6,6, and mixtures thereof, (d) a fourth, barrier layer comprising between 90-100 wt % of an ethylene vinyl alcohol copolymer having an ethylene content between 38-44 mol %, (e) a fifth, inner layer comprising at least one material selected from the group consisting of nylon-6, nylon-6/6,6, and mixtures thereof, (f) a sixth, inner layer comprising at least one material selected from the group consisting of: ultra low density polyethylene, modified-linear low density polyethylene, cyclic olefin copolymers, and mixtures thereof; and (g) a seventh, inner heat sealing layer comprising at least 50 wt % of at least one material selected from the group consisting of: linear low density polyethylene, low density polyethylene, high density polyethylene, and mixtures thereof;

the film being formed into a bag defined by:

a front panel and an opposing back panel connected to one another by a pair of side gusset panels, wherein either the front or back panel comprises a lap seal connecting the inner heat sealing layer to the outer heat sealing layer of the film, and wherein the lap seal extends between a first end and opposing second end of the bag;

a first end seal connecting the inner heat sealing layer on the front panel with the inner heat sealing layer on the back panel between the side gusset panels and proximate to the first end of the bag;

wherein the lap seal is peelable along a lap seal interface located between the outer heat sealing layer and the contaminated layer, where the lap seal has a lap seal peel strength between 250 grams per inch and 3000 grams per inch; and wherein the first end seal comprises a K-seal formation having at least three discreet heat seals proximal to the closed bag end which provides a squared end configuration to the bag and allows the bag to stand upright before it is filled.

21. The bag, as defined in claim 20, further comprising a second end seal connecting the inner heat sealing layer on the front panel with the inner heat sealing layer on the back panel between the side gusset panels and proximate to the second end of the bag.

22. The bag, as defined in claim 20, further comprising a notch on the lap seal for opening the bag in a transverse direction, perpendicular to the lap seal.

* * * * *

UNITED STATES PATENT AND TRADEMARK OFFICE

CERTIFICATE OF CORRECTION

PATENT NO. : 8,827,557 B2
APPLICATION NO. : 13/978176
DATED : September 9, 2014
INVENTOR(S) : Aaron J. Wallander It is certified that error appears in the above-identified patent and that said Letters Patent is hereby corrected as shown below:

In the Specification

In column 6, line 15, delete "(polyauryllactam)," and insert -- (polylauryllactam), --, therefor.

In column 13, line 47, delete "vinylidene" and insert -- polyvinylidene --, therefor.

In column 13, line 66, delete "36" and insert -- 39 --, therefor.

In column 15, line 17, delete "USA:" and insert -- USA. --, therefor

In the Claims

In column 17, line 35, in claim 1, delete "bag:" and insert -- bag; --, therefor.

In column 18, line 63, in claim 20, delete "of" and insert -- of: --, therefor.

In column 19, line 1, in claim 20, delete "of" and insert -- of: --, therefor.

In column 19, line 11, in claim 20, delete "of" and insert -- of: --, therefor.

Signed and Sealed this
Twenty-first Day of July, 2015

Michelle K. Lee

Michelle K. Lee
*Director of the United States Patent and Trademark Office*